US008579735B2

(12) United States Patent
Brenner et al.

(10) Patent No.: US 8,579,735 B2
(45) Date of Patent: Nov. 12, 2013

(54) METHOD AND APPARATUS OF TEACHING SERVING IN TENNIS

(76) Inventors: Deborah W. Brenner, Warren, NJ (US); Todd E. Sherman, Colonia, NJ (US)

( * ) Notice: Subject to any disclaimer, the term of this patent is extended or adjusted under 35 U.S.C. 154(b) by 177 days.

(21) Appl. No.: 12/953,619

(22) Filed: Nov. 24, 2010

(65) Prior Publication Data

US 2011/0294610 A1 Dec. 1, 2011

Related U.S. Application Data

(60) Provisional application No. 61/264,503, filed on Nov. 25, 2009.

(51) Int. Cl.
*A63B 69/38* (2006.01)

(52) U.S. Cl.
USPC ..... 473/464

(58) Field of Classification Search
USPC ..... 473/459, 461, 464; 434/247
See application file for complete search history.

(56) References Cited

U.S. PATENT DOCUMENTS

| | | | | |
|---|---|---|---|---|
| 3,937,465 | A | 2/1976 | Roland | |
| 4,094,504 | A | 6/1978 | Barasch | |
| 4,105,204 | A | 8/1978 | Koenig | |
| 4,163,552 | A | 8/1979 | Tiso | |
| 4,519,608 | A | 5/1985 | Gilly | |
| 4,852,875 | A | 8/1989 | McLennan | |
| 4,911,441 | A | 3/1990 | Brunner | |
| 5,060,942 | A | 10/1991 | Dalbo | |
| 5,080,362 | A | 1/1992 | Lillard | |
| 5,257,779 | A | 11/1993 | Dalbo | |
| 5,340,102 | A | 8/1994 | Adamson | |
| 5,439,214 | A | 8/1995 | Dalbo | |
| 5,520,049 | A | 5/1996 | Butler, Jr. | |
| 5,542,676 | A | 8/1996 | Howe, Jr. | |
| 5,554,033 | A | 9/1996 | Bizzi | |
| 5,618,040 | A | 4/1997 | Parten | |
| 5,700,205 | A | 12/1997 | Sanford | |
| 5,715,539 | A * | 2/1998 | Benecki et al. | 2/160 |
| 5,796,005 | A | 8/1998 | Frolow | |
| 5,846,086 | A | 12/1998 | Bizzi | |
| 6,056,653 | A | 5/2000 | Boldin | |
| 6,102,809 | A | 8/2000 | Nichols | |
| 6,134,965 | A | 10/2000 | Somville | |
| 6,270,430 | B1 | 8/2001 | Nicoloff | |
| 6,270,434 | B1 | 8/2001 | Shaw | |
| 6,461,255 | B1 | 10/2002 | Smith | |
| 6,645,094 | B2 | 11/2003 | Obidiegwu | |
| 6,648,780 | B1 | 11/2003 | Boldin | |
| 6,830,520 | B1 | 12/2004 | Bollar | |
| 7,052,447 | B2 * | 5/2006 | Whittaker | 482/124 |

(Continued)

*Primary Examiner* — Raleigh W Chiu
(74) *Attorney, Agent, or Firm* — Robert L. Shaver; Dykas & Shaver

(57) ABSTRACT

Disclosed is a method and a device for practicing a tennis serve, learning how to perform a tennis serve, and for teaching a student how to perform a tennis serve. The method includes placing an indicator band on the server's thumb joint, placing a positioning indicator on the throat of the server's racquet, standing at the baseline in a serving position, bringing the racquet to the tossing hand and physically touching the positioning band on the thumb with the indicator band on the racquet, dropping both hands together, one hand holding the ball and one hand holding the racquet, then extending the throwing hand skyward and releasing the ball with the palm of the hand up, and bringing the racquet around and striking the ball at the apogee of its arc.

2 Claims, 7 Drawing Sheets

(56) References Cited

U.S. PATENT DOCUMENTS

| | | | | |
|---|---|---|---|---|
| 7,147,581 | B1 | 12/2006 | Williams, III | |
| 7,335,118 | B1 | 2/2008 | Sung | |
| 7,350,786 | B1 | 4/2008 | Georgis | |
| 7,445,570 | B2 | 11/2008 | Rodgers | |
| 7,867,145 | B2 * | 1/2011 | Bearden | 482/44 |
| 2004/0132538 | A1 * | 7/2004 | Oury et al. | 473/205 |
| 2006/0185057 | A1 * | 8/2006 | Terpinski | 2/160 |
| 2008/0220911 | A1 | 9/2008 | Rodgers | |
| 2009/0143172 | A1 | 6/2009 | Morshed | |
| 2010/0261581 | A1 * | 10/2010 | Bearden | 482/47 |
| 2011/0053736 | A1 * | 3/2011 | Bearden | 482/47 |
| 2011/0294610 | A1 * | 12/2011 | Brenner et al. | 473/464 |
| 2012/0148991 | A1 * | 6/2012 | Coutlee | 434/247 |

* cited by examiner

METHOD AND APPARATUS OF TEACHING SERVING IN TENNIS

PRIORITY/CROSS-REFERENCE TO RELATED APPLICATIONS

This application claims the benefit of U.S. Provisional Application No. 61/264,503, filed Nov. 25, 2009, the disclosure of which is incorporated by reference.

TECHNICAL FIELD

The presently disclosed and claimed inventive concept generally relates to a method of teaching serving in tennis, and more particularly to a method that utilizes interactive markers on the hand of the server and the throat of the racquet to teach serving in tennis.

BACKGROUND

Tennis is a very popular sport in the United States and has a following of many fans and players. A critical part of a tennis game is the serve, and it is also one of the most difficult parts of the game to learn and also to teach. What is required to perform a successful serve is for the player to position his body in the right position next to the baseline, to toss the ball in a very repeatable manner into the air, to strike the ball at or near the high point of the ball's trajectory above the player, and to have the ball not only go over the net into the opposite player's court, but also to hit the smaller serving area which is adjacent to the net. This combination of steps is a difficult thing for any player to achieve, and especially difficult to teach, and difficult for a beginning player to accomplish.

One method to improve a person's tennis serve is to simply hit a lot of balls, with the idea that sufficient practice will improve a person's form. The drawback with that assumption is that the player may have incorrect form and merely by practicing he may not correct his form. There would be no standards with which to compare his bodily position and enable him to improve his serve.

A number of training devices also exist which provide the opportunity for a beginning tennis player to practice throwing the ball into the air and striking the ball when it is high in the air.

What is needed is a training method that can be used by tennis trainers as well as by tennis players who have no trainer available, and by use of a video, and which conveys to them in a simple manner a repeatable procedure which results in good form and successful serving.

DISCLOSURE OF THE INVENTION

The invention is a method of teaching serving in tennis, utilizing a tennis racquet, a serving line (base line), and a tennis player, designated the server, who will use the tennis racquet to hit a tennis ball. The tennis racquet described will be a tennis racquet of normal configuration which has a grip handle, a throat, strings, and a head. The head portion of the tennis racquet is generally ovoid in shape and is crisscrossed by carefully tensioned strings.

The first step of the procedure is to place a proximity indicator on the tennis racquet, at the place where the head of the racquet meets the throat of the racquet. The proximity indicator can be a magnet unit paired with a magnet attracting unit, two magnet units, an LED light that is activated by proximity or a sound emitting unit which is activated by proximity with a corresponding unit. Although one magnet attached by an adhesive layer is specified, obviously, a second adhesive attached magnet can be placed on the opposite side of the racquet.

The next step involves placing a second proximity indicator on the server's tossing hand, on his thumb between the thumb joint and the knuckle, on the anterior aspect of the proximal phalangees of the thumb. As with the first proximity indicator, the second proximity indicator can be a magnetic unit, an LED light that is activated by proximity or a sound emitting unit which is activated by proximity with a corresponding unit.

The next step is the server facing parallel to the serving line with the server's feet, knees, hips, shoulders, and head all facing parallel to the serving line. The next step is turning the foot which is closest to the serving line 30-45° toward the serving line, while also turning the head and shoulder 30-45 degrees toward the serving line The next step is bouncing the ball with the tossing hand then, holding the ball in the pads of the fingers, and with the ball in the tossing hand, turning the hand with the palm up to the sky with the ball in the tossing hand. The next step is holding the tossing arm against the server's torso, with the forearm at a 90° angle to the upper arm, with the ball in the tossing hand. The next step is verifying that with the tossing arm in the bent position, the proximity sensor on the thumb band is visible on the interior aspect of the proximal phalangees of the thumb.

The next step is bringing the racquet and the tossing hand together in front of the server's body so that the proximity indicator on the racquet throat interacts with the proximity sensor the server's thumb. If these proximity sensors are both small magnetic patches, they click together if they are in the right position, and they easily come apart as the racquet is swung. LED or sound based proximity sensors light up or make a sound when sufficiently close.

The next step is holding the racquet at 90° to the forearm of the serving arm, with the forearm at 90° to the upper arm. The next step is dropping both the tossing hand and the racquet, simultaneously, by straightening both arms. The next step is extending the serving arm over the head and to the sky with the palm up, and releasing the fingers around the ball so that the ball continues to travel in an upward direction. The next step is simultaneous with extending the serving arm, and that is raising the racquet and serving arm so that the upper arm is even with the shoulder and the forearm is at 90° from the upper arm. The next step is rotating the forearm of the racquet arm at the elbow to strike the ball, as it is momentarily suspended in the air or close to the apogee of the arc, with the face of the racquet.

The next step is moving the tossing hand down to the server's tossing side hip as the serving forearm is swinging the racquet toward the ball. The next step is following through with the serving arm to bring the racquet to the opposite side of the body, and ending the serve with the racquet in the tossing hand, between the thumb and the index finger, and with the two proximity indicators in contact.

The invention is also a device made up of a tennis racquet mountable first proximity sensor, and a thumb mountable second proximity sensor, both configured to interact with each other by magnetic attraction, by lighting an LED bulb, or by emitting a sound, all based on proximity to each other. These sensors are used as described in the description of the method above.

DESCRIPTION OF PREFERRED EMBODIMENTS

Shown in FIGS. 1 through 7 are the two devices that make up the device for teaching tennis. The Figures also show the steps in the method of using the device for teaching tennis serving or learning how to serve a tennis ball.

Figure 1:
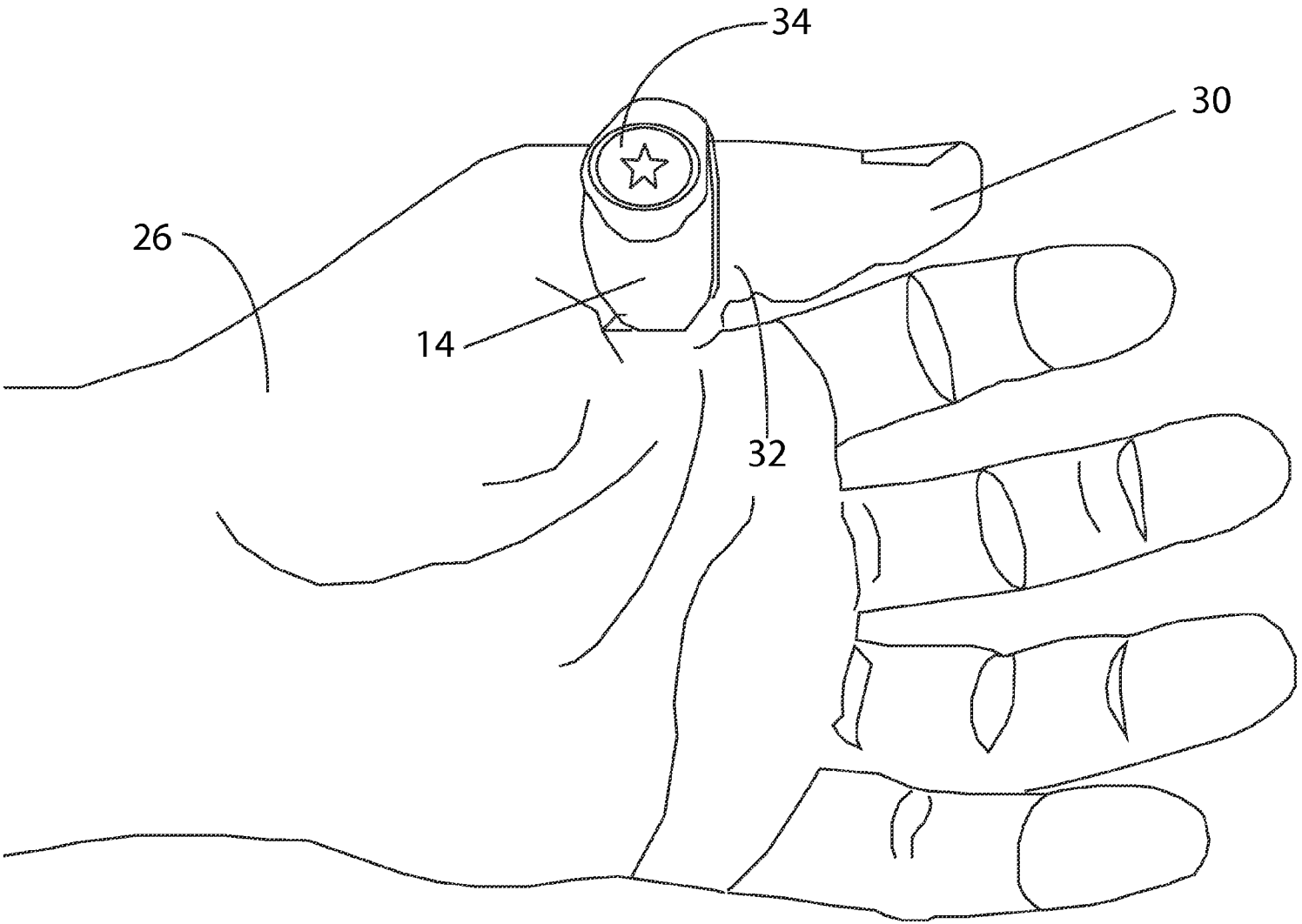
FIG. 1 is a view of the second proximity indicator, mounted on a server's tossing hand.

Shown in FIG. 1 is the second proximity indicator 14 which is utilized in the device and as well as the method of teaching tennis of the invention. The second proximity indicator 14 can take a number of forms, but a preferred version is a neoprene band with a magnetic region. The second proximity indicator 14 may be approximately one inch in diameter, and configured to fit over the proximal phalanx 32 of the thumb 30 of the user. A right handed user would place the second proximity indicator on the left thumb as shown, and a left handed user would place the second proximity indicator 14 on the right thumb. Included in the second proximity indicator in this particular embodiment is a magnetic disk 34, positioned near the exterior of the second proximity indicator 14. The second proximity indicator 14 could take a number of other forms such as being a ring made of plastic or metal, or any other suitable structure which attaches to the thumb of the user. One material that works for this device includes an elastic cloth band with embedded magnet unit, and a silicone band with a magnetically responsive portion. In one preferred embodiment, the first proximity indicator 12 and the second proximity sensor 14 need not both be magnetic. One may be magnetic as long as the other is responsive to magnetic attraction.

Figure 2:
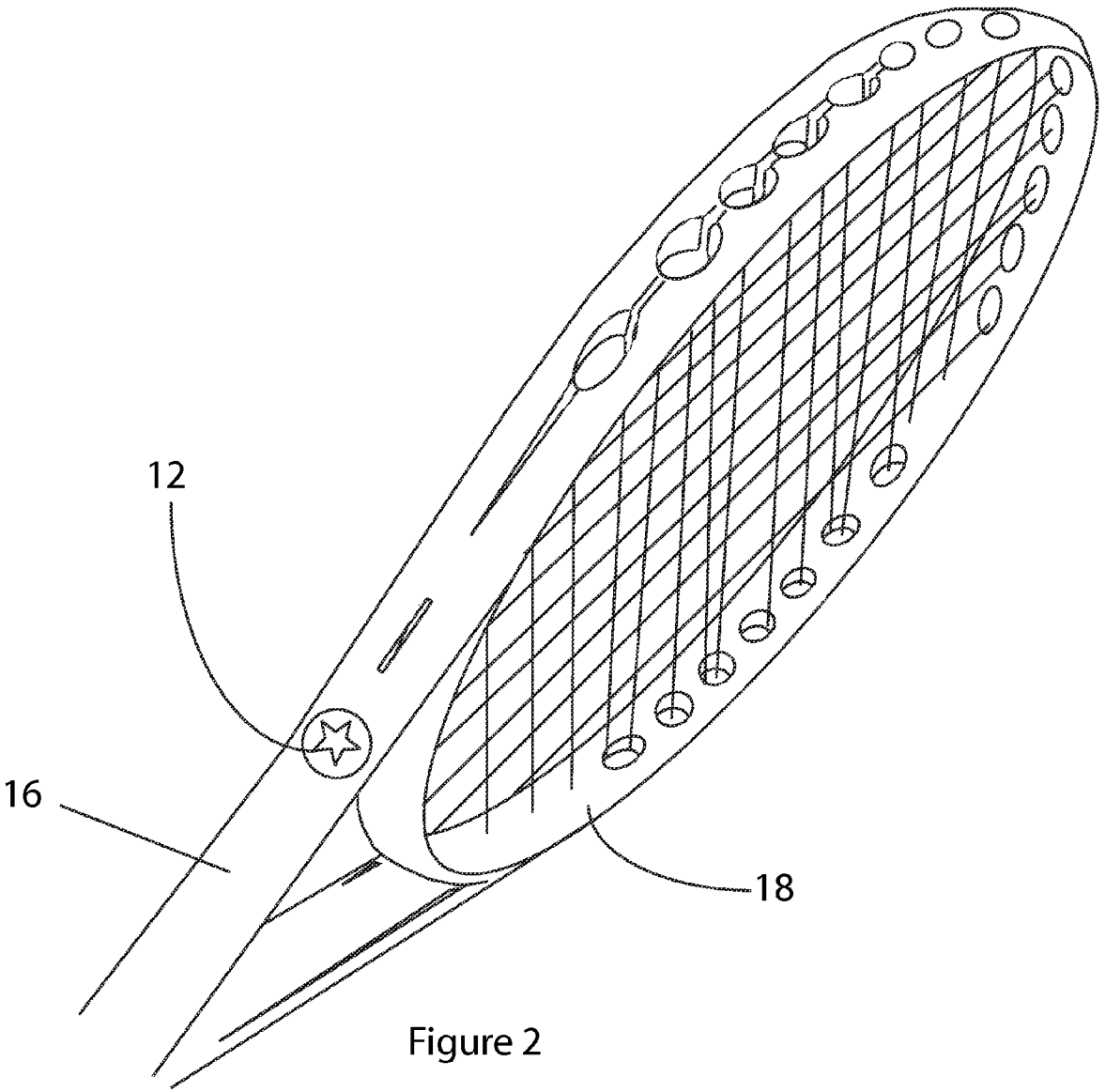
FIG. 2 is a perspective view of the first proximity indicator, attached to the throat of a tennis racquet.

FIG. 2 shows a first proximity indicator 12 attached to the throat 16 of a tennis racquet 18. The preferred version of a first proximity indicator 12 is a magnetic disk attached with an adhesive to the tennis racquet 18.

Figure 3:
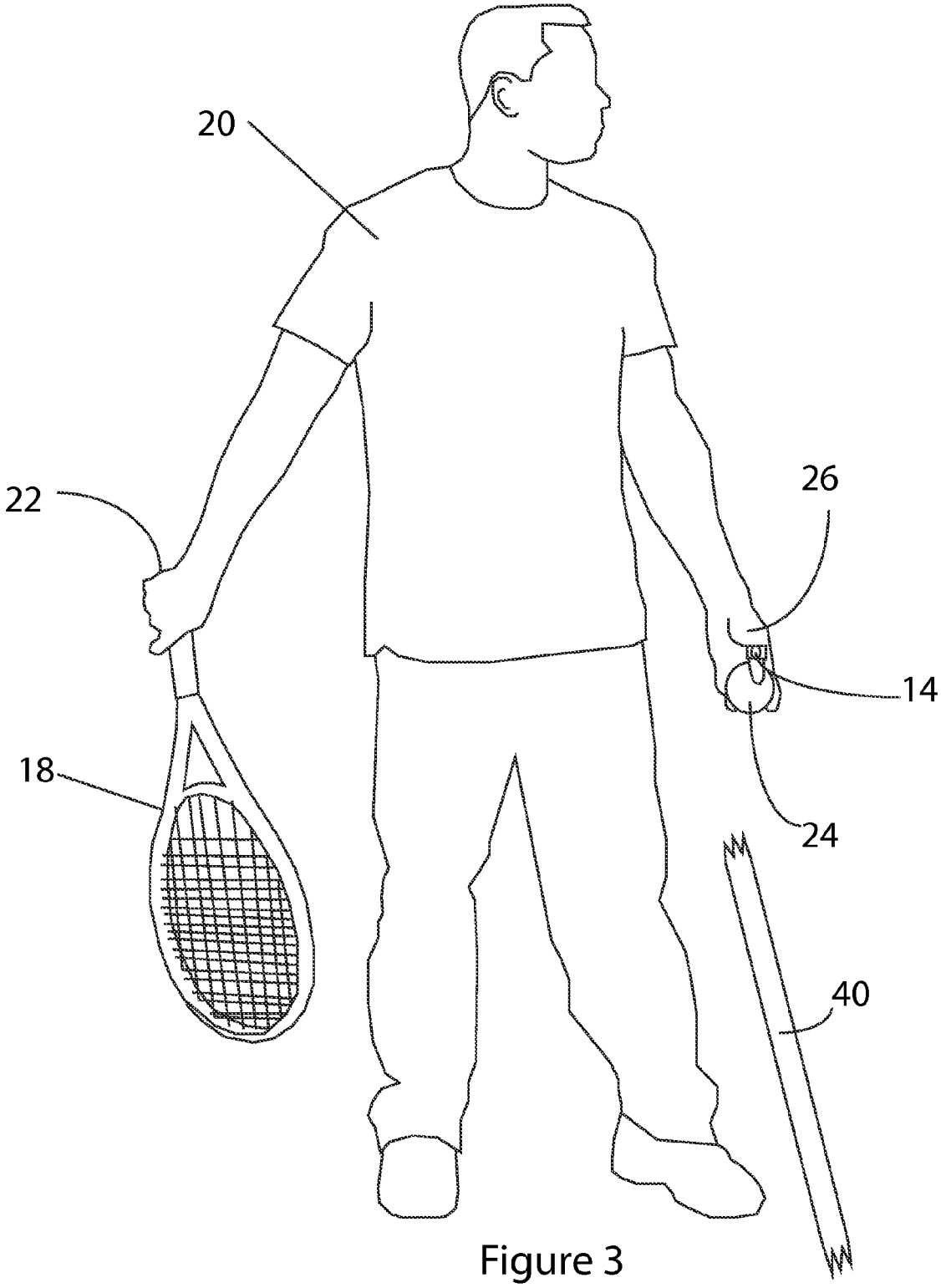
FIG. 3 is a view of the tennis player, in position at the base line to begin the sequence of serving a tennis ball.

FIG. 3 illustrates the next step of the method, one in which both the first proximity indicator 12 and the second proximity indicator 14 are utilized. In this step the tennis player or server 20 faces parallel to the serving line 40 with the feet, knees, hips, shoulders, and head all facing parallel to the serving line 40. The racquet is held in the server's serving hand and the racquet 18 is in the server's serving hand 22 and the ball 24 is in the server's tossing hand 26. Next the foot closest to the serving line 40 is rotated 30-35 degrees towards the serving line 40, and the servers head and shoulders also rotate 30-35 degrees toward the serving line. FIG. 3 shows the foot, the head, and the shoulders rotated towards the serving line and the serving line 40.

Figure 4:
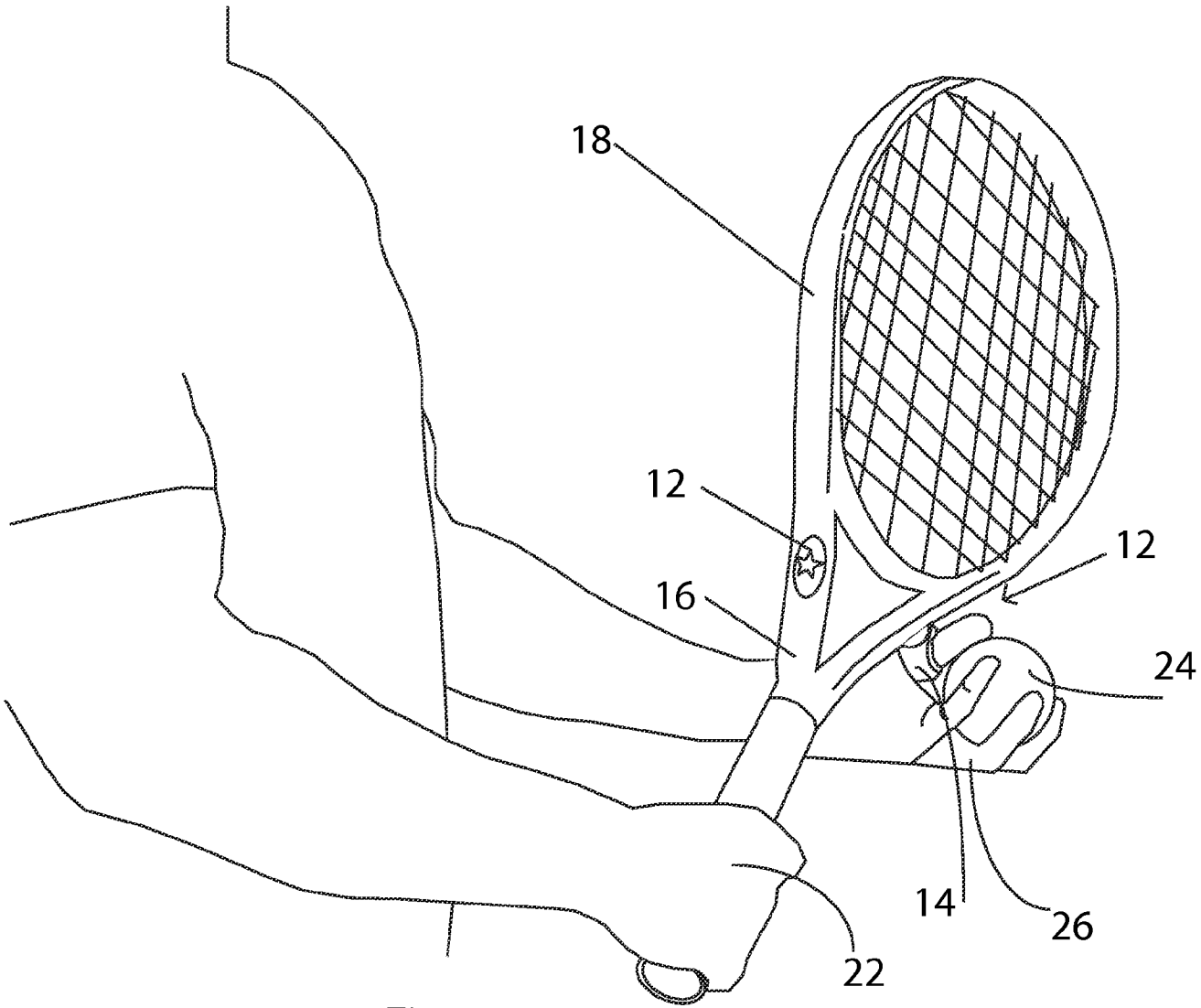
FIG. 4 is a perspective view of the tennis player bringing the first and second proximity indicators together in front of his body.

FIG. 4 shows a second proximity indicator 14 which has been brought into contact with a first proximity indicator 12, which is attached to the throat 16 of a tennis racquet 18. In a preferred embodiment, the first proximity indicator 12 is a disk made of a magnetic material which is attached to the tennis racquet with an adhesive. The first proximity indicator 12 is shown on the side of the racquet throat opposite the second proximity indicator, for the purpose of showing the correct positioning on the throat 16. In use at least one first proximity indicator 12 would be in place adjacent to the position of the second proximity indicator 14 shown in FIG. 4. A first proximity indicator 12 can be positioned on each side of the racquet throat 16 as shown in FIG. 4. The first proximity indicator 12 is shown having a star on its outside surface, which can serve as a visual indicator but is not critical to the device.

In the position shown in FIG. 4, the tossing hand 26 is held with the ball held in the finger pads of the tossing hand 26 with the upper arm of the tossing hand adjacent to the body, the forearm at approximately 90 degrees to the body and with the hand turned so that the palm is facing the sky. This position is shown in FIG. 4. At this point the server verifies that the tossing arm position is in the bent position, with the second proximity indicator visible on the interior thumb of the tossing hand, as shown in FIG. 4. The next step of the method is to bring the serving hand 22 into the same position as shown in FIG. 4. After bringing the first and second proximity indicators 12 and 14 together at waist level as shown in FIG. 2, both hands are dropped as shown in FIG. 3. When the two proximity indicators are brought together, they touch with a click, since at least one of the proximity indicators is magnetic, and the other is either magnetic or responsive to magnetic attraction.

FIG. 3 shows both hands are dropped down from the position in FIG. 4. Thus FIG. 3 shows the hands-down position before that of FIG. 4, and the hands-down position immediately after that of FIG. 4.

Figure 5:
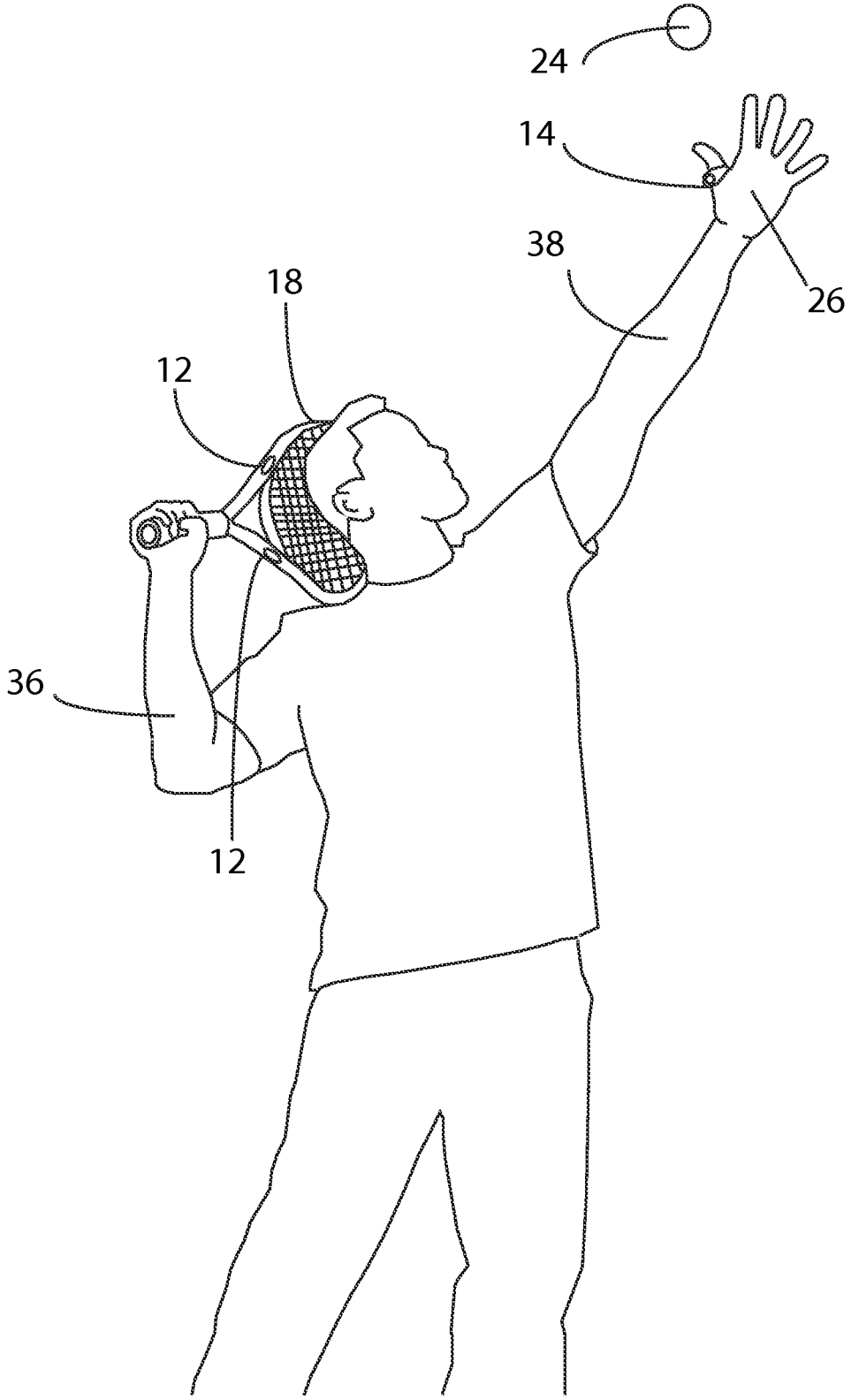
FIG. 5 is a view of the tennis player tossing the tennis ball into the air and preparing to strike the ball with the tennis racquet.

FIG. 5 shows the next step which is to simultaneously raise the racquet 18 and the serving arm 36 so that the upper arm is even with the shoulder and the forearm is at a 90 degree angle from the upper arm, as shown in FIG. 5. At the same time the tossing arm 38 is extended to the sky with the palm up and the ball 24 is released from the pads of the fingers and the ball continues its upper motion for a short distance.

Figure 6:
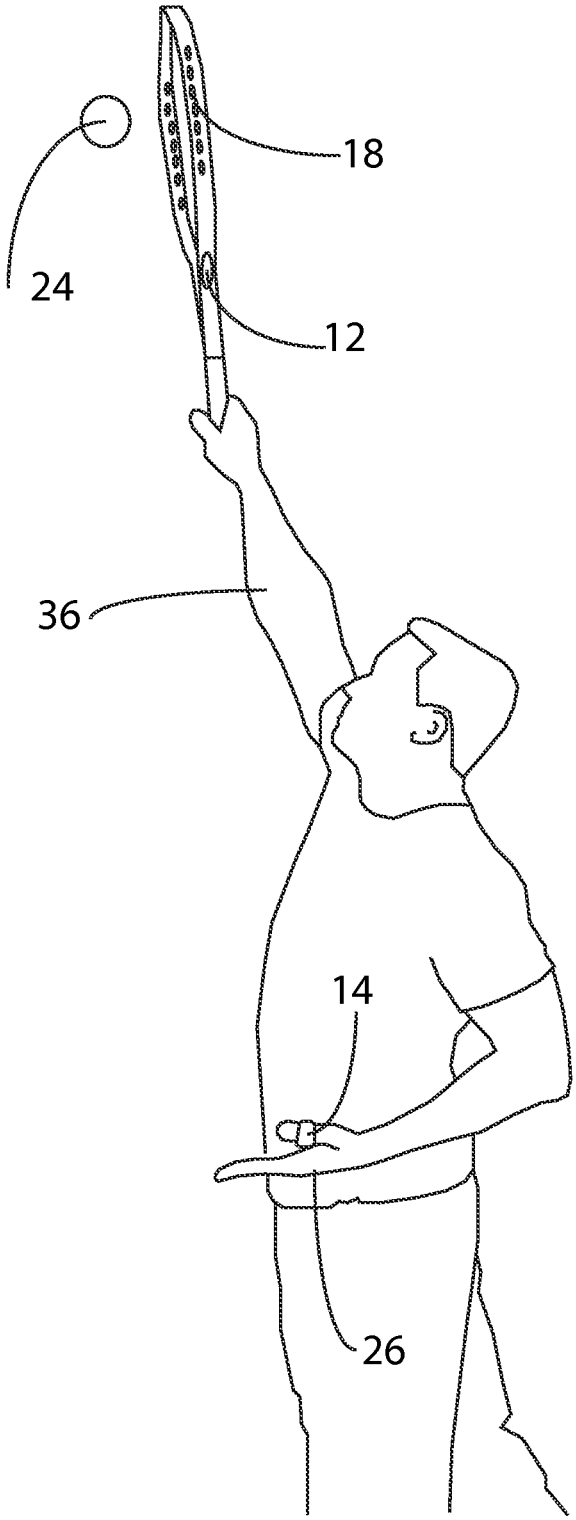
FIG. 6 is a view of the tennis player striking the tennis ball with the tennis racquet.

The next step is shown in FIG. 6, in which the forearm of the serving arm 36 is rotated at the elbow and the racquet is extended overhead towards to strike the ball 24 as it is suspended in the air. The ball is struck with the face of the racquet 18.

Figure 7:
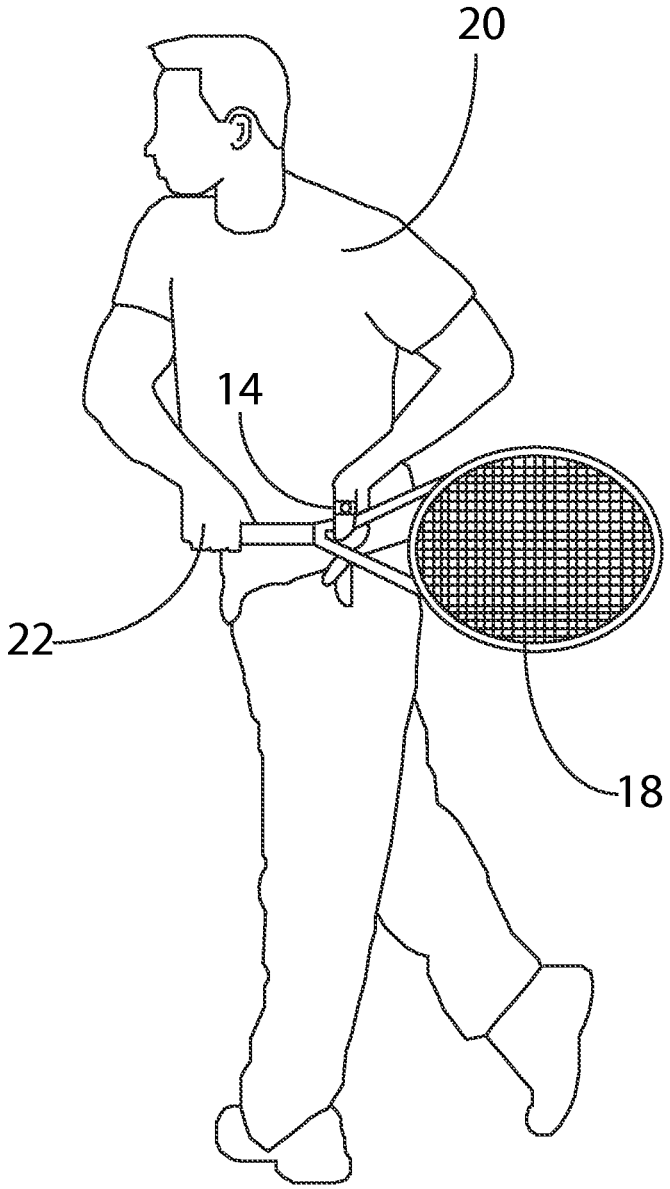
FIG. 7 is a view of the tennis player following through from striking the tennis ball and bringing the first and second proximity indicators together at his waist.

FIG. 7 shows the next step, which is to move the tossing hand down to the server's hip as the forearm of the serving hand is swinging the racquet toward the ball. Then the serving arm follows through by bringing the racquet to the opposite side of the server's body and ending the serve with the racquet in the tossing hand between the thumb and the index finger.

What is claimed is:

1. A tennis serve teaching device comprising: a tennis racquet mountable first proximity sensor, and a thumb mountable second proximity sensor in the form of a thumb band, in which said first and second proximity sensors comprise at least one LED light, which is configured to activate when in proximity to the corresponding proximity sensor.

2. The tennis serve teaching device of claim 1, in which said first and second proximity sensors comprise at least one audible unit, which is configured to activate when in proximity to the corresponding proximity sensor.

* * * * *